US006595811B2

(12) United States Patent
Dagenais et al.

(10) Patent No.: US 6,595,811 B2
(45) Date of Patent: Jul. 22, 2003

(54) PERSONAL WATERCRAFT VEHICLE COMPONENT MULTIPLEX COMMUNICATION SYSTEM

(75) Inventors: Dominic Dagenais, Canton de Shefford (CA); Stéphane Proulx, Valcourt (CA); Yves Berthiaume, Palm Bay, FL (US); Eric Quellette, Austin (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 10/021,308

(22) Filed: Dec. 19, 2001

(65) Prior Publication Data

US 2002/0077007 A1 Jun. 20, 2002

Related U.S. Application Data

(60) Provisional application No. 60/256,308, filed on Dec. 19, 2000.

(51) Int. Cl.[7] ..... B63H 21/22
(52) U.S. Cl. ..... 440/1; 440/2; 440/84
(58) Field of Search ..... 440/1, 2, 38, 84

(56) References Cited

U.S. PATENT DOCUMENTS

| | | | | |
|---|---|---|---|---|
| 4,177,454 A | * | 12/1979 | Shinoda et al. | 340/309.4 |
| 4,646,295 A | * | 2/1987 | Basile | 370/488 |
| 5,043,727 A | * | 8/1991 | Ito | 340/984 |
| 5,418,526 A | * | 5/1995 | Crawford | 370/464 |
| 5,507,672 A | * | 4/1996 | Imaeda | 440/1 |

OTHER PUBLICATIONS

Road Vehicle—Interchange of Digital Information—Controller Area Network (CAN) for High–Speed Communication, Draft International Standard ISO/DIS, 11898, ISO/TC 22/SC 3, ISO 1992, pp. 26 and 35 (dated Feb. 20, 1992).

CDCan/D Rev 4.0, Digital DNA from Motorola, Motorola Integrated CAN Technology CD–Rom, 1998, Motorola Inc., pp. 4 and 14.

* cited by examiner

*Primary Examiner*—Stephen Avila
(74) *Attorney, Agent, or Firm*—Pillsbury Winthrop LLP

(57) ABSTRACT

The personal watercraft vehicle (PWC) component multiplex communication system, as described herein, is configured to accommodate the exchange of information between PWC components. The system employs an engine electronic control unit (ECU), a multipurpose ECU, and a cluster ECU. Management and monitoring data collected from the various PWC components are transmitted to the corresponding ECUs, which process and multiplex the data along with control messages into an aggregate serial data stream and supplies the aggregate data stream to a system bus. System bus interconnects each of the ECUs and accommodates the bi-directional transfer of the aggregate multiplexed data stream to the ECUs and may be configured as a 2-wire interconnection. Accordingly, the ECUs receive and de-multiplex the aggregate data stream containing the data and control messages generated by other ECUs. The control message generation, multiplexing, de-multiplexing, and aggregate data stream transmission and reception operations may be performed in accordance with the Controller Area Network (CAN) protocol. As such, PWC component multiplex communication system facilitates the exchange of data between PWC components without relying on cumbersome conventional wiring harnesses and networks.

29 Claims, 5 Drawing Sheets

PERSONAL WATERCRAFT VEHICLE COMPONENT MULTIPLEX COMMUNICATION SYSTEM

CROSS REFERENCE TO RELATED APPLICATION

This application claims priority from and the benefit of U.S. Provisional Application Ser. No. 60/256,308, filed Dec. 19, 2000, the disclosure of which, including the specification, drawings and abstract, is incorporated herein by reference in its entirety.

BACKGROUND OF THE INVENTION

1. Field of the Invention

The present invention generally relates to personal watercraft vehicles. In particular, the present invention relates to a novel multiplex communication system capable of exchanging information between components of a personal watercraft vehicle.

2. Description of Related Art and General Background

In an effort to improve reliability and increase operator comfort and safety, personal watercraft (PWCs) vehicles, much like their land and air counterparts, have recently included electronic systems to assist watercraft operations as well as to control and monitor key watercraft components. For example, PWCs may employ electronic mechanisms, such as, sensors, gauges, and controllers, to furnish trekking information, such as watercraft velocity, air and water temperature, travel distance, and directional/navigation data. PWCs may additionally employ such mechanisms to operational information, such as, indicate fuel, oil, and battery levels, engine speed, engine temperature, and engine status.

Generally, these electronic mechanisms are electrically coupled to specific PWC components, requiring dedicated communication paths or links therebetween. Such dedicated links are typically achieved by implementing a network of wired interconnections between the mechanisms and components. Naturally, the more features incorporated in PWCs, the more sophisticated the electronic systems, and the more complicated and cumbersome the wiring networks. In some cases, the wiring networks are configured as wiring harnesses, comprising bundled wires and cables, and conventional methods for configuring, installing, and maintaining wiring networks may prove to be difficult and cost-prohibitive.

Moreover, the drawbacks of conventional wiring networks are exacerbated by the fact that PWCs suffer from strict space limitations. By design, PWCs contain hydrodynamic profiles and contours that subject wiring harnesses to cramped spaces, odd angles, and complex routing configurations, which may require the bending, curving, and twisting of the harness and, hence, compromise the integrity of the harness's bundled wires. Consider, for example, the cross-sectional side view of a PWC 100, as depicted in FIG. 1. PWC 100 includes an instrumentation panel or cluster 104, facing towards the operator as he or she is seated in a straddle-type seat 101, in order to display information to the operator. Such information may include display trekking and operational information, such as watercraft velocity, air and water temperature, battery levels, engine speed, engine temperature, and engine status. Cluster 104 is coupled to various electronic mechanisms via a conventional wiring harness 106. In particular, conventional wiring harness 106 comprises a plurality of wires connecting cluster 104 to the electronic mechanisms coupled to the PWC 100 components that furnish the desired information.

Cluster 104 may be mounted on a cluster mounting portion 108 on the bow portion 110 of the PWC 100 deck. The cluster mounting portion 108 may have a substantially slanted and streamlined profile from its aft end 108A to its fore end 108B. As illustrated in FIG. 1, such a profile limits the space available to route a large conventional wiring harnesses 106 that provides connectivity between cluster 104 and various PWC 100 components.

Furthermore, PWC 100 may include a bow storage compartment 112 used for storing items. Storage compartment 112 may be disposed in bow portion 110 of PWC 100, underneath mounting portion 108. In this configuration, mounting portion 108 may be hingedly-attached, via a hinge 109, to bow portion 110 and serve as a hood or lid to storage compartment 112. Mounting portion 108 may, therefore, be selectively opened or closed to provide entry into, or conceal, storage compartment 112. Such opening and closing of mounting portion 108 may, over time, compromise the integrity of the bundled wires within conventional wiring harness 106.

It will be appreciated that wiring networks are also susceptible to the harsh conditions typically experienced by PWCs 100. Wiring networks have to be protected from external influences, such as, moisture, rapid temperature fluctuations, salt, dirt, vibrations, and mechanical impacts. Given the strict space limitations noted above, it may be difficult to ensure the protection of conventional wiring networks from these external influences.

It will also be appreciated that conventional wiring networks limit the number of modifications and upgradeable options available on PWCs. Simple changes to cluster 104 displays, for example, may require identifying associated cables, untangling wiring harnesses, installing new cables, and test/troubleshooting new connections. The performance and expense of such tasks generally discourage PWC modifications.

SUMMARY OF THE INVENTION

Systems and methods consistent with the principles of the present invention, as embodied and broadly described herein, provide for a multiplex communication system capable of exchanging information between components of a personal watercraft vehicle.

In one embodiment, the multiplex communication system includes an engine electronic control unit electrically coupled to a plurality of watercraft engine sensors in which the watercraft engine sensors are operatively coupled to the watercraft engine and generate watercraft engine-related data and the engine electronic control unit is configured to process the engine-related data. The system also includes a multipurpose electronic control unit electrically coupled to a plurality of watercraft operation sensors in which the watercraft operation sensors are operatively coupled to a plurality of watercraft components and generate watercraft operational data and the multipurpose electronic control unit is configured to process the operational data. The system further includes a cluster electronic control unit coupled to a cluster display apparatus in which the cluster display apparatus is configured to display the engine-related and operational data. The system also provides for a system bus configured to operatively interconnect the engine electronic control unit, the multipurpose electronic control unit, and the cluster electronic control unit and arranged to support the transmission of said engine-related and operational data. Each of the electronic control units communicate with each other and exchange data via the system bus.

Additional aspects of the present invention include providing the electronic control units with processing mechanisms and associated memory devices, wherein the processing performed by the electronic control units include computation of performance parameters, control message generation, and multiplexing/de-multiplexing and transmission/reception operations in accordance with the Controller Area Network transmission protocol.

Other aspects of the present invention include configuring the system bus as a 2-wire circuit and incorporating a terminating connector at one end of the bus to terminate the 2-wire bus circuit and incorporating a terminating resistor within the engine electronic control unit disposed at the opposite end of the 2-wire bus circuit to terminate the circuit. In addition, the interconnection of the electronic control units is achieved by arranging the system bus in a T configuration, such that the multipurpose electronic control unit is implemented as a bridge connecting the engine electronic control unit at one end of the system bus and the terminating connector at the opposite end of the system bus. The cluster electronic control unit is connected to the multipurpose electronic control unit between the engine electronic control unit and the terminating connector.

BRIEF DESCRIPTION OF THE DRAWINGS

In the drawings, like reference numerals represent similar parts of the present invention throughout the several views and wherein.

DETAILED DESCRIPTION OF THE INVENTION

The following detailed description refers to the accompanying drawings that illustrate embodiments of the present invention. Other embodiments are possible and modifications may be made to the embodiments without departing from the spirit and scope of the invention. Therefore, the following detailed description is not meant to limit the invention. Rather the scope of the invention is defined by the appended claims.

The PWC component multiplex communication system, as described herein, is configured to accommodate the exchange of information between PWC components. The system employs a PWC component electronic control unit (ECU), coupled to various PWC components, and a cluster ECU, coupled to the cluster display apparatus. Management and/or monitoring data collected from the various PWC components are transmitted to the corresponding ECUs, which process and multiplex the data into an aggregate serial data stream and supply the aggregate data stream to a system bus. The system bus accommodates the bi-directional transfer of the aggregate data stream to the ECUs for processing and may be configured as a 2-wire or 3-wire interconnection. For example, generally each ECU may recognize and record data identifying PWC component faults detected by the sensors, which may then be displayed by the cluster display apparatus on command. As such, the PWC component multiplex communication system of the present invention facilitates the exchange of data between PWC components without relying on cumbersome conventional wiring harnesses and networks.

Figure 2A:
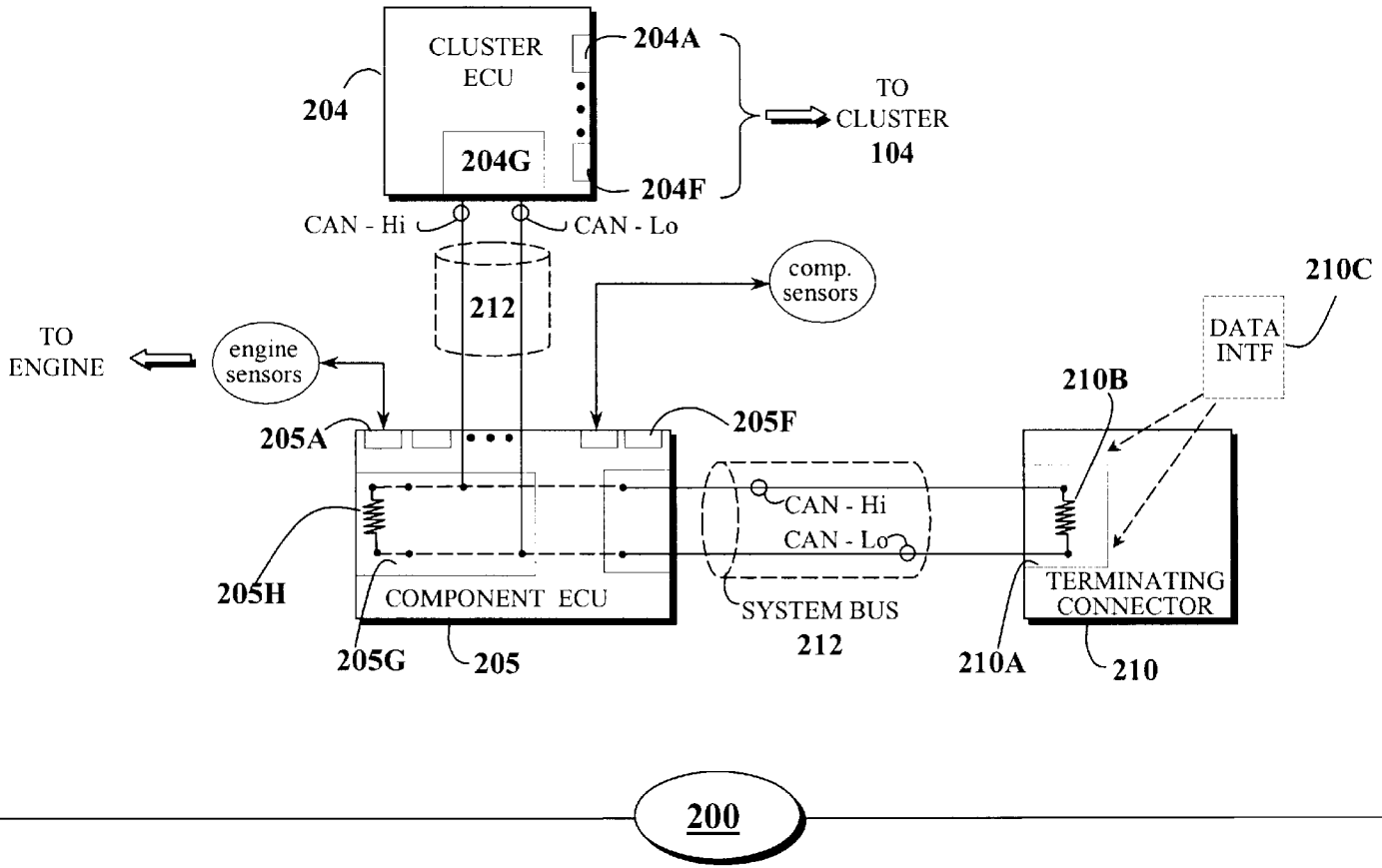
FIG. 2A is a functional block diagram illustrating a personal watercraft vehicle component multiplex communication system, in accordance with an embodiment of the present invention.

FIG. 2A is a functional block diagram depicting a PWC component multiplex communication system 200, constructed and operative in accordance with an embodiment of the present invention. As illustrated in FIG. 2A, system 200 operatively couples a cluster ECU 204, a PWC component ECU 205, and a terminating connector 210 via a system bus infrastructure 212. Although not illustrated in FIG. 2A, power may be supplied to these components by well known techniques, including a 2-wire connection to a battery, PWC generator, or other power source suitable for such purposes.

Figure 1A:
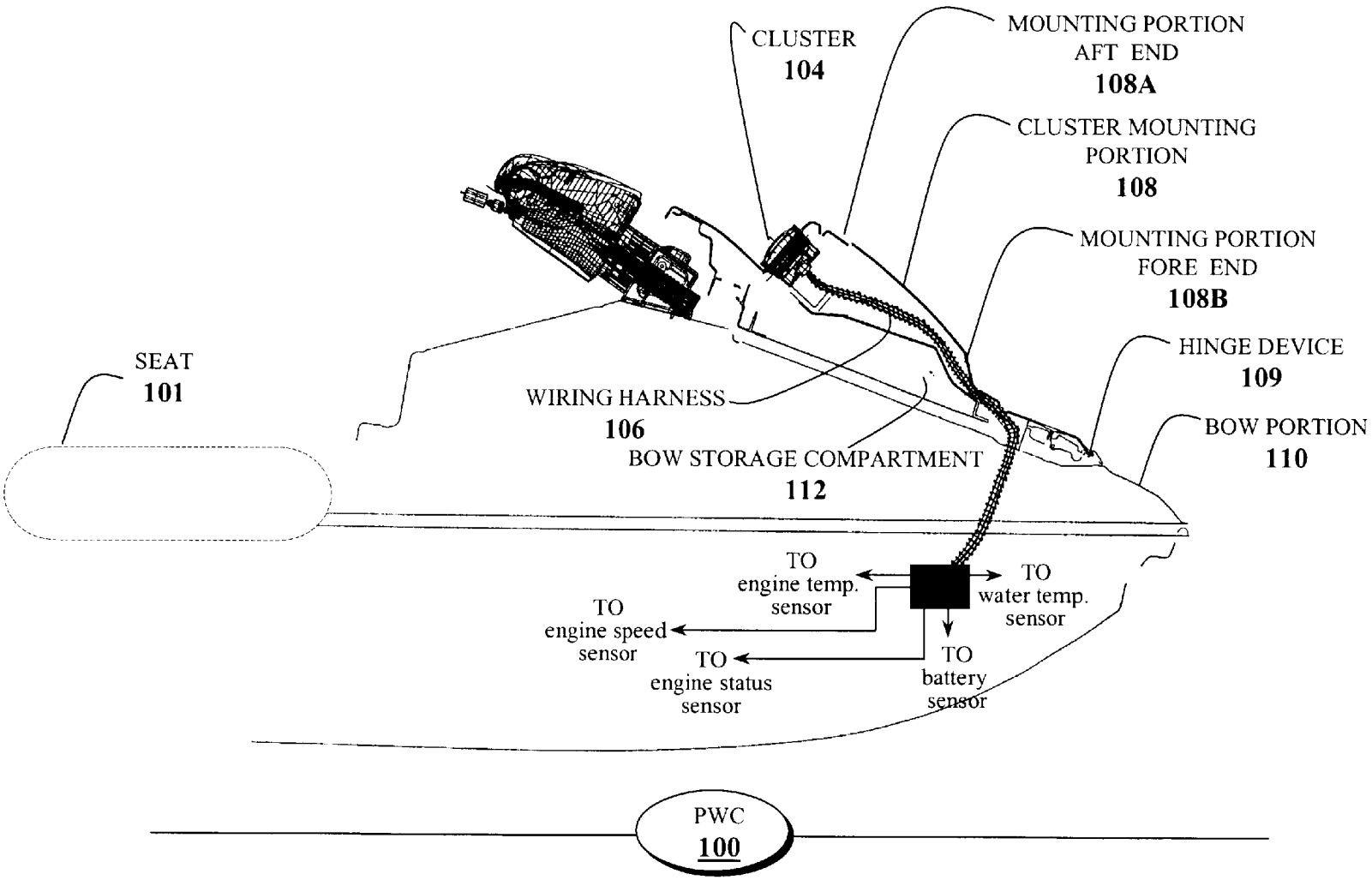
FIG. 1A (RELATED ART)
FIG. 1A is a cross-sectional side view of a personal watercraft vehicle depicting a conventional component wiring network.
Figure 1B:
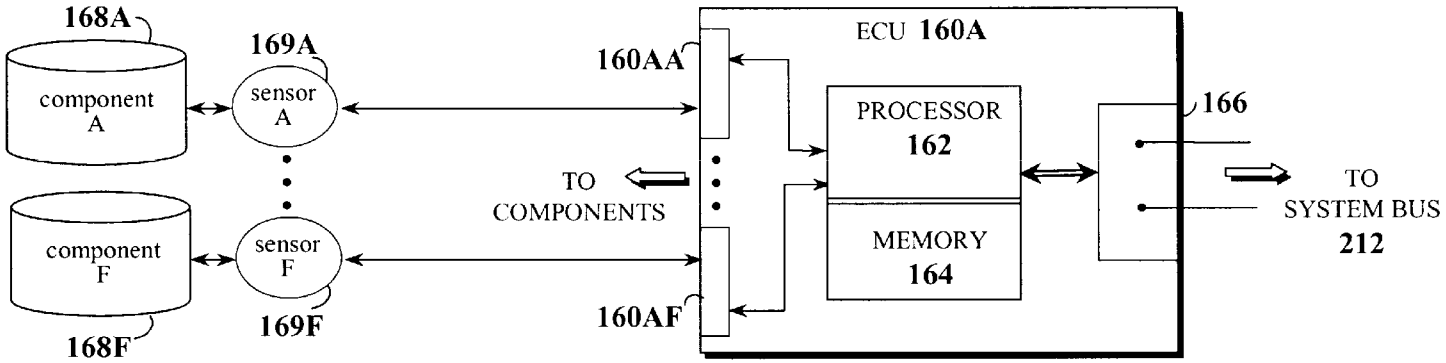
FIG. 1B (RELATED ART)
FIG. 1B is a functional block diagram illustrating an electronic control unit.
Figure 1C:
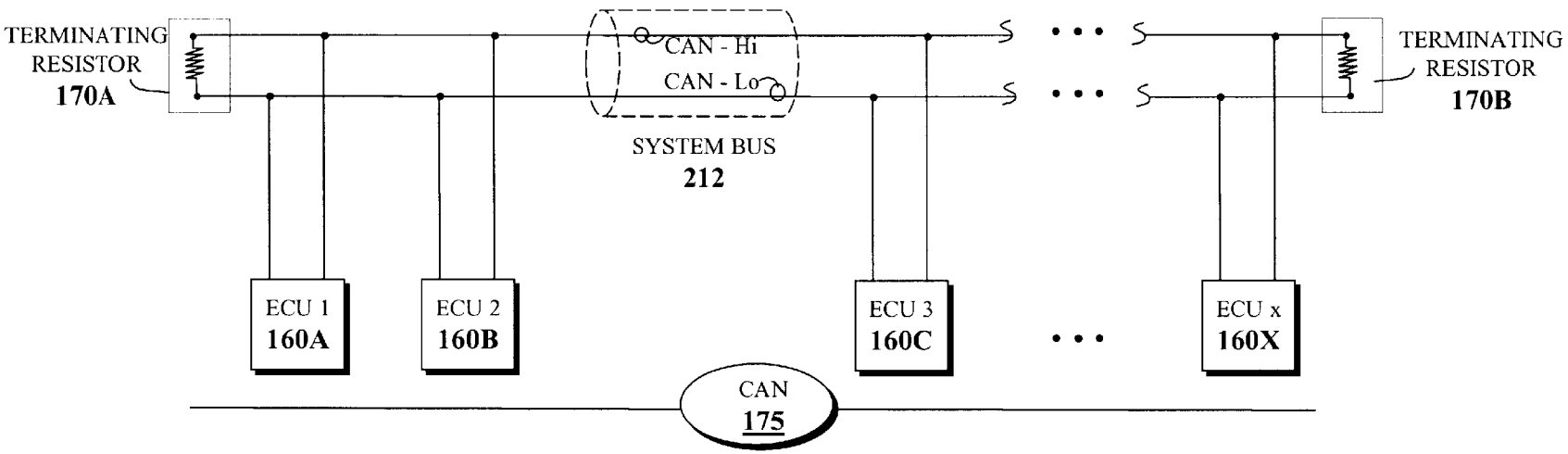
FIG. 1C (RELATED ART)
FIG. 1C is a block diagram illustrating the topology of a Controller Area Network (CAN)

In an exemplary implementation, each of the ECUs 204, 205 employed by system 200 is configured similar to ECU 160A, as depicted in FIG. 1B. ECU 160A comprises a processing mechanism 162, a memory mechanism 164, a plurality of sensor interfaces 160AA–160AF, and a system bus interface 166.

Data used in the management and/or monitoring of various PWC components 168A–168F may be furnished by electrically coupling the PWC components 168A–168F with sensors or transducers 169A–169F. Sensors 169A–169F are configured to generate predetermined digital data signals in response to measuring various attributes or performance characteristics of the PWC components 168A–168F, such as, for example, the detection of faulty components. The digital data signals produced by sensors 169A–169F are supplied to ECU 160A via sensor interfaces 160AA–160AF.

The digital data signals received by sensor interfaces 160AA–160AF are routed to processing mechanism 162. Processing mechanism 162 may be configured to process the data signals, such as computing the performance parameters or identification of faulty components used in the management and/or monitoring of PWC components 168A–168F. Processing mechanism 162 may also be configured to prepare the data signals for transmission and reception across system bus 212, in accordance with the well known data communication protocols, such as, for example, the Controller Area Network (CAN) protocol specified by International Standards Organization (ISO) standard 11898.

The CAN protocol specifies a wiring topology and provides for the generation of control messages, arbitration rules for system bus 212 access, and methods for fault detection/isolation. In brief, the CAN protocol prescribes the wiring topology depicted in FIG. 1B. Each ECU 160A–160X is coupled to a 2-wire system bus 212 circuit, which accommodates the transfer of data between the ECUs 160A–160X and allow each ECU 160A–160X to communicate and exchange data with each other. The CAN protocol employs the 2-wire system bus 212 configuration to effect a balanced signaling scheme, whereby one wire conveys signals representing data bits with a predetermined high voltage (i.e., CAN-Hi), while the other wire conveys signals representing data bits with a predetermined low voltage (i.e., CAN-Lo). System bus 212 also includes terminating resistors 170A, 170B disposed at the ends of the bus 212 to terminate the 2-wire circuit. It will be appreciated that system bus 212 may also be configured as a 3-wire system, whereby the first wire conveys signals representing data bits with a predetermined high voltage (i.e., CAN-Hi), the second wire conveys signals representing data bits with a predetermined low voltage (i.e., CAN-Lo), and the third wire is used as a ground wire.

The CAN protocol also specifies the generation, transmission, and reception of control messages by ECUs 160A–160X. For example, the digital data signals collected from external sources (e.g., sensors) are processed by ECUs 160A–160X, which include generating information (e.g., performance parameters) in response to the collected data. ECUs 160A–160X then perform multiplexing operations on the processed data and/or control messages to generate an aggregate serial digital data stream, in accordance with a standardized CAN message format. The aggregate serial digital data stream is then supplied to system bus 212 via system bus interface 166 and transmitted to other ECUs in accordance with the CAN arbitration process. The CAN arbitration process specifies how ECUs access and seize system bus 212 to regulate the traffic on the bus 212 and facilitate the transmission and reception of the aggregate data stream.

The CAN protocol further provides for a message format for the aggregate data stream. The message format contains a maximum message length of 94 bits and comprising an 11 bit or 29 bit arbitration field, a control field, a data field including 0–8 bytes, a 15 bit cyclical redundancy code (CRC) field, an acknowledgment (ACK) field, and an end of frame (EOF) field.

To this end, memory mechanism 164 is operatively coupled to processing mechanism 162 and is configured to store data as well as programmed instructions to be used and executed by processing mechanism 162, in performance of its processing tasks. As noted above, such tasks may include computation of performance parameters, control message generation, CAN multiplexing/de-multiplexing and transmission/reception operations. Memory mechanism 164 may comprise a random access memory (RAM) device or equivalent.

Returning to FIG. 2A, PWC component multiplex communication system 200 employs PWC component ECU 205, which is dedicated to managing and/or monitoring attributes of the PWC components. Such components may include, for example, the PWC engine, engine subsystems, diagnostic components, navigational components, battery, fuel tank, etc. Accordingly, component ECU 205 includes sensor interfaces 205A–205F, which are coupled to component sensors. The component sensors are configured to produce digital data signals representative of functional and performance attributes of the PWC components, including the identification of faulty components. Such sensors may include, for example, engine speed (RPM) sensors, engine temperature sensors, engine status sensors, air and water temperature sensors, directional sensors, PWC velocity sensors, and oil and fuel level sensors. Consistent with the ECU operations noted above, component ECU 205 may be configured to receive the data signals from the component sensors, process the data signals, generate data and/or control messages, and multiplex the data and messages into the aggregate serial digital data stream. Component ECU 205 may, in accordance with CAN arbitration processes, supply the aggregate data stream, via component system bus interface 205G, to system bus 212. The component data contained in the aggregate data stream may then be transmitted to other ECUs (e.g., cluster ECU 204) across system bus 212 for management and/or monitoring purposes.

By virtue of the bi-directional transfer of the aggregate serial digital data stream across system bus 212, component ECU 205 is also capable of receiving data initiated by other ECUs (e.g., cluster ECU 204), intended for the management and/or monitoring of the PWC components. In particular, component ECU 205, receives the aggregate serial digital data stream from system bus 212, via component system bus interface 205G, and routes the aggregate stream to its corresponding processing mechanism. The processing mechanism then processes the aggregate stream. Such processing includes de-multiplexing the aggregate stream to extract the relevant digital data and control messages generated by the other ECUs as well as computing performance parameters used in the management and/or monitoring of the PWC components.

PWC component multiplex communication system 200 further employs cluster ECU 204, which is devoted to accommodating operational information used by display cluster 104. As noted above, display cluster 104 is configured to display trekking and operational information, such as PWC velocity, air and water temperature, directional/navigation information, battery levels, engine speed, engine temperature, and engine status. Cluster ECU 204 may, therefore, rely on component ECU 205 to furnish such operational information. As such, cluster ECU 204 may be configured to receive, via cluster system bus interface 204G, data and control messages generated by component ECU 205 embedded in the aggregate serial digital data stream. Cluster ECU 204 may then de-multiplex the aggregate data stream, process the relevant data and control messages, and forward the processed data and messages, via cluster interfaces 204A–204F, to cluster 104, accordingly.

As illustrated in FIG. 2A, PWC component multiplex communication system 200 interconnects cluster ECU 204, component ECU 205, and a terminating connector 210, via system bus 212. As noted above, system bus 212 may be configured as a 2-wire or 3-wire circuit, capable of supporting the bi-directional transfer of the aggregate serial digital data stream and facilitating communication between the ECUs 204, 205, in accordance with the CAN protocol. Component ECU 205 may be equipped with a terminating resistor 205H for terminating the 2-wire system bus 212 circuit at one end. Commensurately, at the other end of system bus 212, system 200 incorporates a terminating connector 210, configured with terminating resistor 210B to terminate the other end of the circuit. Alternatively, terminating resistor 210B may be disposed elsewhere within component ECU 205 or cluster ECU 204 to terminate the circuit. In addition, terminating connector 210 may also be configured as a selectably detachable connector in order to facilitate the disengagement of terminating connector 210 and accommodate the direct connection of a sealed (e.g., waterproof) diagnostic port connector interface 210C to the circuit. Such a configuration provides for the coupling of data link to an external computer in order to communicate with system 200 and extract on-board diagnostic information.

Figure 2B:
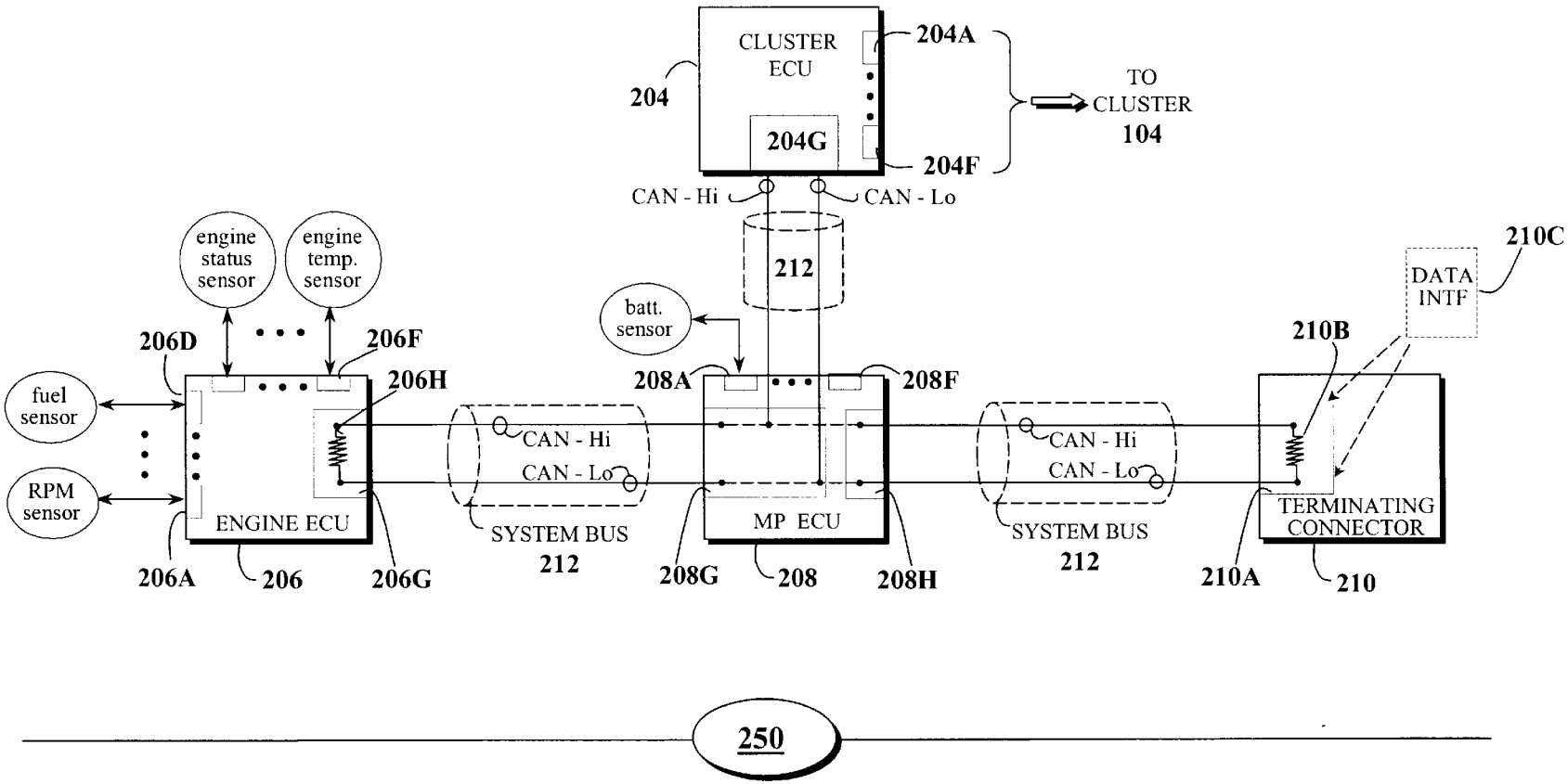
FIG. 2B is a functional block diagram illustrating a personal watercraft vehicle component multiplex communication system, in accordance with another embodiment of the present invention.

FIG. 2B, illustrates PWC component multiplex communication system 250, constructed and operative in accordance with another embodiment of the present invention. In system 250, the functionality of component ECU 205 is separated and serviced by two ECUs, engine ECU 206 and multipurpose (MP) ECU 208. Engine ECU 206 may be dedicated to managing and/or monitoring attributes of the PWC engine (not shown) and/or engine subsystems. Accordingly, engine ECU 206 includes engine sensor interfaces 206A–206F, which are coupled to engine sensors configured to produce digital data signals representative of functional and performance attributes of the PWC engine and/or engine subsystems. Such sensors may include, for example, engine speed (RPM) sensors, engine temperature sensors, engine status sensors, and oil and fuel level sensors. Consistent with the ECU operations noted above, engine ECU 206 may be configured to receive the data signals from the engine sensors, process the data signals, generate data and/or control messages, and multiplex the data and messages into the aggregate serial digital data stream. Engine ECU 206 may, in accordance with CAN arbitration processes, supply the aggregate data stream, via engine system bus interface 204G, to system bus 212. The engine-related data contained in the aggregate data stream may then be transmitted to other ECUs (e.g., cluster ECU 204, MP ECU 208) across system bus 212 for management and/or monitoring purposes.

The personal watercraft vehicle (PWC) component multiplex communication system, as described herein, is configured to accommodate the exchange of information between PWC components. The system employs an engine ECU, an MP ECU, and a cluster ECU. Management and/or monitoring data collected from the various PWC components are transmitted to the corresponding ECUs, which process and multiplex the data along with control messages into an aggregate serial data stream and supplies the aggregate data stream to a system bus. System bus interconnects each of the ECUs and accommodates the bi-directional transfer of the aggregate data stream to the ECUs and may be configured as a 2-wire or 3-wire interconnection. Accordingly, the ECUs receive and de-multiplex the aggregate data stream containing the data and control messages generated by other ECUs. The control message generation, multiplexing, de-multiplexing, and aggregate data stream transmission and reception operations may be performed in accordance with the Controller Area Network (CAN) protocol. As such, PWC component multiplex communication system facilitates the exchange of data between PWC components without relying on cumbersome conventional wiring harnesses and networks. It is to be noted that, although not illustrated in FIG. 2B, power may be supplied to these components by well known techniques, including a 2-wire connection to a battery, PWC generator, or other power source suitable for such purposes.

Engine ECU 206 is also capable of receiving data initiated by other ECUs (e.g., cluster ECU 204, MP ECU 208), intended for the management and/or monitoring of the PWC engine and/or engine subsystems. In particular, engine ECU 206, receives the aggregate serial digital data stream from system bus 212, via engine system bus interface 206G, and routes the aggregate stream to its corresponding processing mechanism. The processing mechanism then processes the aggregate stream. Such processing includes de-multiplexing the aggregate stream to extract the relevant digital data and control messages generated by the other ECUs as well as computing performance parameters used in the management and/or monitoring of the PWC engine and/or engine subsystems.

As noted above, PWC component multiplex communication system 250 further employs MP ECU 208, which is configured as a multipurpose ECU, capable of handling the managing and/or monitoring attributes of PWC components, other than the engine. MP ECU 208 includes MP sensor interfaces 208A–208F, which are coupled to sensors configured to produce trekking and operational information, such as, for example, PWC velocity and water temperature. MP sensor interfaces 208A–208F may also be coupled to diagnostic sensors for providing access to diagnostic and servicing tools. Much like the ECUs noted above, MP ECU 208 may be configured to receive the data signals from the multipurpose sensors, process the data signals, generate data and control messages, and multiplex the data and control messages into the aggregate serial digital data stream. MP ECU 208 may supply the aggregate data stream to a system bus 212, via MP system bus interface 208G. The multipurpose data contained in the aggregate data stream may then be forwarded to other ECUs (e.g., cluster ECU 204, engine ECU 206) for management and/or monitoring purposes.

MP ECU 208 may also receive data from other ECUs (e.g., cluster ECU 204, engine ECU 206) through MP system bus interface 208G. In particular, MP ECU 208 may be configured to receive, via MP system bus interface 208G, data contained within the aggregate serial digital data stream that is generated by other ECUs and may additionally store relevant data. For example, other ECUs may recognize and record PWC component faults, which may then be transferred and stored in MP ECU 208. This fault information may then be accessed by cluster ECU 204 and displayed, upon command, by cluster apparatus 104. As such, MP ECU 208 may de-multiplex the aggregate data stream, extract the relevant data and control messages, and process the data and control messages, in accordance with management and/or monitoring operations. MP ECU 208 may also forward the processed data signals, via engine interfaces 208A–208F, to the corresponding PWC components, accordingly.

In addition, PWC component multiplex communication system 250 employs cluster ECU 204, which may receive data from other ECUs (e.g., MP ECU 208, engine ECU 206) through MP system bus interface 208G and is configured to handle the display of relevant information. Such displayed information may include directional/navigational information, as ambient air temperature, and faulty PWC component identification.

As illustrated in FIG. 2B, PWC component multiplex communication system 250 interconnects cluster ECU 204, engine ECU 206, multipurpose (MP) ECU 208, and terminating connector 210, via system bus 212. As noted above, system bus 212 may be configured as a 2-wire or 3-wire circuit, capable of supporting the bi-directional transfer of the aggregate serial digital data stream and facilitating communication between the ECUs 204, 206, 208, in accordance with the CAN protocol. In an exemplary implementation, system bus 212 is arranged in a logical "T" configuration, whereby MP ECU 208 is implemented as a bridging ECU, providing connectivity between engine ECU 206, disposed at one end of the bus circuit, and terminal connector 210, disposed at the opposite end of the bus circuit (see FIG. 2B). Cluster ECU 204 is coupled to MP ECU 208 in between engine ECU 206 and terminal connector 210. In this manner, ECUs 204, 206, 208 may be positioned close to their corresponding components, allowing 2-wire system bus 212 to traverse most of the distances between the ECUs. In addition, such an implementation promotes modularity between the PWC 100 components. For example, the PWC engine, engine subsystems, engine sensors, and engine ECU 206 may be packaged independent from the rest of the PWC components, sensors, and ECUs, thereby facilitating PWC 100 modifications and upgrades.

Figure 3:
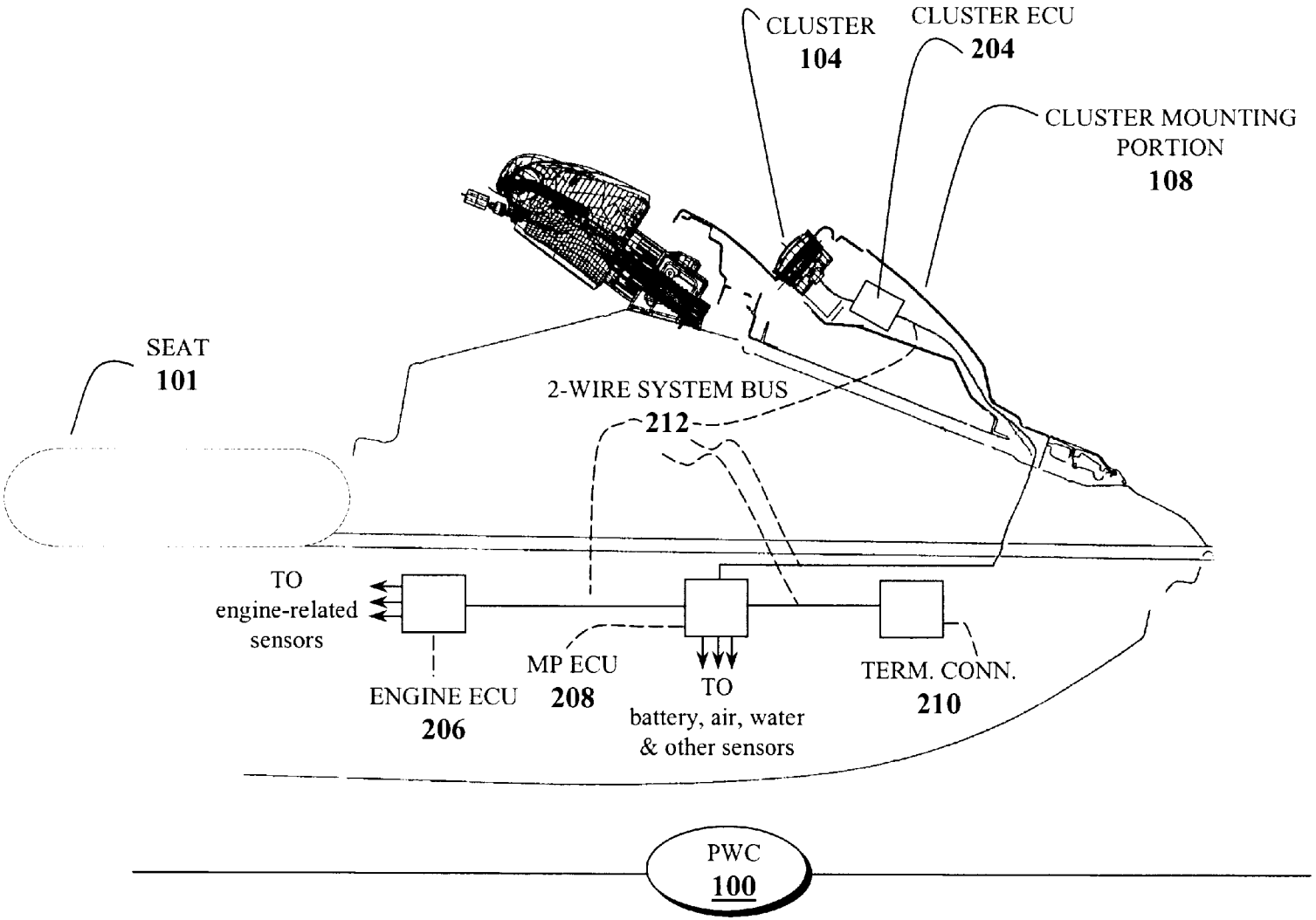
FIG. 3 is a cross-sectional side view of a personal watercraft vehicle depicting the installation configuration of personal watercraft vehicle component multiplex communication system, in accordance with an embodiment of the present invention.

By way of example, consider the exemplary implementation of PWC component multiplex communication system 250, as depicted in FIG. 3. In this implementation, all the elements of system 250, and their respective interconnections, are installed within the interior of PWC 100. This protects system 250 from the external influences experienced by PWCs.

Moreover, by configuring MP ECU 208 as a bridging ECU, cluster ECU 204 may be positioned close to cluster 104, reducing intra-cluster cabling. Also, as illustrated in FIG. 3, 2-wire system bus 212 may be extended internally from cluster 104 to MP ECU 208 by routing system bus 212 along the underside of mounting portion 108. As noted above, the underside of mounting portion 108 is space limited, making the routing of cables problematic for conventional wiring schemes.

Furthermore, by using a bridging ECU, engine ECU 206 may be positioned closer to the engine (not shown), which allows for the localization of engine sensors, engine sensor cabling, and engine ECU 206. As such, the use of a bridging MP ECU 208 and the "T" configuration of system bus 212, optimizes the PWC wiring network and ECU placement, reduces inter-component cabling, and enhances wiring reliability.

PWC component multiplex communication system 250 also incorporates a terminating resistor 206H within engine ECU 206. In the system bus 212 configuration noted above, engine ECU 206 is disposed at a terminal end of system bus 212. By doing so, engine system bus interface 206G is equipped with a terminating resistor 206H for terminating the 2-wire system bus 212 circuit. Commensurately, at the other end of system bus 212, system 250 incorporates a terminating connector 210, configured with terminating resistor 210B to terminate the other end of the 2-wire circuit. In addition, terminating connector 210B may also be configured as a selectably detachable connector in order to facilitate the disengagement of terminating connector 210B and accommodate the direct connection of a sealed (e.g., waterproof) diagnostic port connector interface 210C to the circuit. Such a configuration provides for the coupling of data link to an external computer in order to communicate with system 200 and extract on-board diagnostic information.

As presented herein, PWC component multiplex communication system allows for the exchange of data between PWC components while significantly reducing intercomponent cabling. Such reduction in cabling simplifies PWC wiring schemes and enhances wiring reliability. Moreover, by incorporating ECUs with processing mechanisms, the system provides for on-board diagnostics and facilitates PWC modifications and upgrades.

It will be apparent to one of ordinary skill in the art that the embodiments as described below may be implemented in many different embodiments of software, firmware, and hardware in the entities illustrated in the figures. The actual software code or specialized control hardware used to implement the present invention is not limiting of the present invention. Thus, the operation and behavior of the embodiments will be described without specific reference to the actual software code or specialized hardware components. The absence of such specific references is feasible because it is clearly understood that artisans of ordinary skill would be able to design software and control hardware to implement the embodiments of the present invention based on the description herein.

Moreover, the processes associated with the presented embodiments may be stored in any storage device, such as, for example, non-volatile memory, an optical disk, magnetic tape, or magnetic disk. Furthermore, the processes may be programmed when the system is manufactured or via a computer-readable medium at a later date. Such a medium may include any of the forms listed above with respect to storage devices and may further include, for example, a carrier wave modulated, or otherwise manipulated, to convey instructions that can be read, demodulated/decoded and executed by the system.

The foregoing description of the preferred embodiments is provided to enable any person skilled in the art to make or use the present invention. Various modifications to these embodiments are possible, and the generic principles presented herein may be applied to other embodiments as well. For example, the invention may be implemented in part or in whole as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a microprocessor or other digital signal processing unit.

As such, the present invention is not intended to be limited to the embodiments shown above but rather is to be accorded the widest scope consistent with the principles and novel features disclosed in any fashion herein.

What is claimed is:

1. A personal watercraft vehicle, comprising:

a hull;

a deck mounted on said hull;

a display apparatus mounted on said deck;

an engine;

a propulsion system operatively coupled to said engine to provide propulsion for said watercraft;

a plurality of sensors adapted to monitor an associated watercraft condition and generate data indicative of the watercraft condition;

a component electronic control unit electrically coupled to said sensors and configured to process the data;

a display electronic control unit coupled to said display apparatus, said display apparatus configured to display the data;

a system bus configured to operatively interconnect said component electronic control unit and said display electronic control unit, said system bus arranged to support multiplexed transmission of the data; and a terminating connector containing a terminating resistor for terminating said system bus, wherein each of said component control unit and display electronic control unit are configured to communicate with each other and exchange the multiplexed data via said system bus.

2. The personal watercraft vehicle of claim 1, wherein at least one of said component electronic control unit and said display electronic control unit includes a sensor interface for communicating with said sensors.

3. The personal watercraft vehicle of claim 1, wherein said sensors include at least one of engine speed sensors, engine temperature sensors, fuel level sensors, oil level sensors, oil pressure sensors, engine status sensors, direction sensors, navigation sensors, battery charge level sensors, watercraft speed sensors, air temperature sensors, water temperature sensors, and travel distance sensors.

4. The personal watercraft vehicle of claim 1, wherein said component electronic control unit and said display electronic control unit include a system bus interface for communicating with said system bus and for accommodating the reception and transmission of the multiplexed data.

5. The personal watercraft vehicle of claim 4, wherein said component electronic control unit and said display electronic control unit include a processing mechanism and a memory device.

6. The personal watercraft vehicle of claim 1, wherein said system bus comprises a system bus circuit having at least one of a 2-wire arrangement and a 3-wire arrangement.

7. The personal watercraft vehicle of claim 6, wherein said terminating connector terminates said system bus circuit.

8. The personal watercraft vehicle of claim 7, wherein said terminating connector is configured as a detachable connector, capable of being selectively removed to accommodate a direct connection of a sealed port connector interface to said system bus circuit to support a data link connection to an external computer in order to extract diagnostic information.

9. A personal watercraft vehicle, comprising:

a hull;

a deck mounted on said hull;

a display apparatus mounted on a movable portion of a bow portion of said deck;

an engine;

a propulsion system operatively coupled to said engine to provide propulsion for said watercraft;

a plurality of sensors adapted to monitor an associated watercraft condition and generate data indicative of the watercraft condition;

a component electronic control unit electrically coupled to said sensors and configured to process the data;

a display electronic control unit coupled to said display apparatus, said display apparatus configured to display the data; and a system bus configured to operatively interconnect said component electronic control unit and said display electronic control unit, said system bus arranged to support multiplexed transmission of the data, wherein each of said component control unit and display electronic control unit are configured to communicate with each other and exchange the multiplexed data via said system bus.

10. The personal watercraft vehicle of claim 9, further including an engine electronic control unit electrically coupled to said sensors and configured to process the data, said engine electronic control engine including include a sensor interface for communicating with said sensors, a system bus interface for communicating with said system bus, a processing mechanism, and a memory device.

11. The personal watercraft vehicle of claim 10, wherein said engine electronic control unit includes a terminating resistor for terminating the system bus circuit.

12. The personal watercraft vehicle of claim 10, wherein said engine electronic control unit, component electronic control unit, display electronic control unit, and said system bus circuit are interconnected in a T configuration, such that said component electronic control unit is implemented as a bridge connecting said engine electronic control unit, disposed at one end of said system bus circuit, with said terminating connector, disposed at the opposite end of said system bus circuit, with said display electronic control unit being connected to said component electronic control unit between said engine electronic control unit and said terminating connector.

13. The personal watercraft vehicle of claim 12, wherein the data processed by said engine electronic control unit comprises engine-related data and the processing of the engine-related data includes at least one of computing engine-related performance parameters based on the engine-related data, generating control messages based on the engine-related data, multiplexing the engine-related data and control messages into an aggregate data stream, and preparing the aggregate data stream for transmission across said system bus circuit.

14. The personal watercraft vehicle of claim 13, wherein the processing of the engine-related data further includes at least one of receiving the aggregate data stream from said system bus circuit, de-multiplexing the aggregate data stream to extract engine-related data and control messages, and performing management or monitoring operations based on the extracted engine-related data and control messages.

15. The personal watercraft vehicle of claim 10, wherein the data processed by said component electronic control unit comprises operational data and the processing of the operational data includes at least one of computing operational performance parameters based on the operational data, generating control messages based on the operational, multiplexing the operational data and control messages into an aggregate data stream, and preparing the aggregate data stream for transmission across said system bus circuit.

16. The personal watercraft vehicle of claim 15, wherein the processing of the operational data further includes at least one of receiving the aggregate data stream from said system bus circuit, de-multiplexing the aggregate data stream to extract operational data and control messages, and performing management or monitoring operations based on the extracted operational data and control messages.

17. The personal watercraft vehicle of claim 16, wherein the communication between said engine electronic control unit, component control unit, and display electronic control unit, the control message generation, the multiplexing and de-multiplexing operations, and the aggregate data stream transmission and reception operations executed by each of said electronic control units is performed in accordance with the Controller Area Network protocol.

18. A personal watercraft vehicle including a component multiplex communication system for exchanging information between components of a personal watercraft vehicle, said personal watercraft vehicle comprising:

a hull;

a deck mounted on said hull;

a display apparatus mounted on said deck;

an engine;

a propulsion system operatively coupled to said engine to provide propulsion for said watercraft;

a plurality of watercraft engine sensors operatively coupled to said engine and configured to monitor an associated engine condition and generate engine-related data indicative of the engine condition;

an engine electronic control unit including a plurality of sensor interfaces electrically coupled to said watercraft engine sensors, said engine electronic control unit including a processing mechanism and memory device in order to process the engine-related data, the processing of the engine-related data including at least one of computing engine-related performance parameters based on the engine-related data, generating control messages based on the engine-related data, multiplexing the engine-related data and control messages into an aggregate data stream, and preparing the aggregate data stream for transmission;

a plurality of watercraft operation sensors operatively coupled to a plurality of watercraft components and configured to monitor associated component conditions and generate operational data indicative of the component condition;

a multipurpose electronic control unit including a plurality of sensor interfaces electrically coupled to said watercraft operation sensors, said multipurpose electronic control unit including a processing mechanism and memory device in order to process the operational data, the processing of the operational data including at least one of computing operational performance parameters based on the operational data, generating control messages based on the operational, multiplexing the operational data and control messages into an aggregate data stream, and preparing the aggregate data stream for transmission;

a display electronic control unit coupled to said display apparatus, said display apparatus configured to display the engine-related and operational data, said display electronic control unit including a processing mechanism and memory device configured to process the engine-related and operational data;

a system bus circuit operatively interconnecting said engine electronic control unit, said multipurpose electronic control unit, and said display electronic control unit and constructed and arranged to support communications and enable exchange of the multiplexed engine-related and operational data between said engine electronic control unit, said multipurpose electronic control unit, and said display electronic control unit; and a terminating connector including a terminating resistance to terminate one end of said system bus circuit, wherein the interconnection of said engine electronic control unit, multipurpose electronic control unit, and display electronic control unit includes arranging said system bus circuit in a T configuration, such that said multipurpose electronic control unit is implemented as a bridge connecting said terminating connector, disposed at the one end of said system bus circuit, to said engine electronic control unit, disposed at an opposite end of said system bus circuit, with said display electronic control unit being connected to said multipurpose electronic control unit between said engine electronic control unit and said terminating connector.

19. The personal watercraft vehicle of claim 18, wherein said watercraft engine sensors include at least one of engine speed sensors, engine temperature sensors, fuel level sensors, oil level and pressure sensors, and engine status sensors.

20. The personal watercraft vehicle of claim 18, wherein said watercraft operation sensors include at least one of direction sensors, navigation sensors, battery charge level sensors, watercraft speed sensors, air temperature sensors, water temperature sensors, and travel distance sensors.

21. The personal watercraft vehicle of claim 18, wherein each of said electronic control unit, multipurpose control unit, and display electronic control unit include a system bus interface for communicating with said system bus circuit and accommodate the receipt and transmission of the multiplexed data.

22. The personal watercraft vehicle of claim 18, wherein said terminating connector is configured as a detachable connector, capable of being selectively removed to accommodate a direct connection of a sealed port connector interface to said system bus circuit to support a data link connection to an external computer in order to extract diagnostic information.

23. The personal watercraft vehicle of claim 22, wherein said engine electronic control unit includes a terminating resistor for terminating the system bus circuit.

24. The personal watercraft vehicle of claim 18, wherein the processing of the engine-related data further includes at least one of receiving the aggregate data stream from said system bus circuit, de-multiplexing the aggregate data stream to extract engine-related data and control messages, and performing management or monitoring operations based on the extracted engine-related data and control messages.

25. The personal watercraft vehicle of claim 18, wherein the processing of the operational data further includes at least one of receiving the aggregate data stream from said system bus circuit, de-multiplexing the aggregate data stream to extract operational data and control messages, and performing management or monitoring operations based on the extracted operational data and control messages.

26. The personal watercraft vehicle of claim 18, wherein the communication between said engine electronic control unit, multipurpose control unit, and display electronic control unit, and the control message generation, the multiplexing and de-multiplexing operations, and the aggregate data stream transmission and reception operations executed by each of said engine electronic control unit, multipurpose control unit, and display electronic control unit is performed in accordance with the Controller Area Network protocol.

27. The personal watercraft vehicle of claim 18, wherein said display apparatus is mounted on a moveable portion of a bow portion of said deck.

28. The personal watercraft vehicle of claim 1, further comprising a straddle-type seat.

29. The personal watercraft vehicle of claim 9, wherein said system bus comprises a system bus circuit having at least one of a 2-wire arrangement and a 3-wire arrangement and said at least one of a 2-wire and a 3-wire arrangement is routed through said movable portion and said bow portion of said deck and connects to said component electronic control unit.

* * * * *